US011194265B2

(12) United States Patent
Watanabe et al.

(10) Patent No.: US 11,194,265 B2
(45) Date of Patent: Dec. 7, 2021

(54) IMAGE FORMING APPARATUS

(71) Applicant: TOSHIBA TEC KABUSHIKI KAISHA, Tokyo (JP)

(72) Inventors: Takeshi Watanabe, Yokohama Kanagawa (JP); Koji Tanimoto, Tagata Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 1 day.

(21) Appl. No.: 16/825,147

(22) Filed: Mar. 20, 2020

(65) Prior Publication Data

US 2021/0294240 A1 Sep. 23, 2021

(51) Int. Cl.

| | |
|---|---|
| ***G03G 15/043*** | (2006.01) |
| ***G03G 15/20*** | (2006.01) |
| ***G03G 15/04*** | (2006.01) |

(52) U.S. Cl.

CPC ..... *G03G 15/043* (2013.01); *G03G 15/04063* (2013.01); *G03G 15/2064* (2013.01)

(58) Field of Classification Search

CPC ..... G03G 15/043; G03G 15/04063; G03G 2215/0412

See application file for complete search history.

(56) References Cited

U.S. PATENT DOCUMENTS

| | | | | |
|---|---|---|---|---|
| 6,777,149 | B2 * | 8/2004 | Ikegami | G03G 5/04 399/159 |
| 7,545,399 | B2 * | 6/2009 | Inoue | G03G 15/0115 347/131 |
| 7,898,562 | B2 * | 3/2011 | Matsuoka | G03G 15/043 347/252 |
| 9,979,856 | B2 * | 5/2018 | Ishikawa | G03G 15/04054 |

FOREIGN PATENT DOCUMENTS

| | | | |
|---|---|---|---|
| JP | H05-69591 | A | 3/1993 |
| JP | H06-328779 | A | 11/1994 |
| JP | 2003-266789 | A | 9/2003 |
| JP | 2004-066762 | A | 3/2004 |
| JP | 2004-249665 | A | 9/2004 |

* cited by examiner

*Primary Examiner* — Erika J Villaluna
(74) *Attorney, Agent, or Firm* — Foley & Lardner LLP

(57) ABSTRACT

An image forming apparatus includes a photoconductor, light emitting elements, a developing device, a fixing device, and a controller. The photoconductor is charged. The light emitting elements form light spots on the photoconductor in order to form an electrostatic latent image on the photoconductor, and are provided to have a first distance with each other in a main scanning direction. The developing device develops an electrostatic latent image on the photoconductor to a toner image. The fixing device fixes the toner image to a sheet. The controller causes the light emitting elements to form first light spots on the photoconductor, causes the photoconductor to move toward the light emitting elements by a second distance shorter than the first distance in a sub-scanning direction orthogonal to the main scanning direction, and causes the light emitting elements to form second light spots on the photoconductor.

17 Claims, 7 Drawing Sheets

IMAGE FORMING APPARATUS

FIELD

Embodiments described herein relate generally to an image forming apparatus.

BACKGROUND

Recently, in an image forming apparatus for forming an image on a sheet, a small exposure device represented by a light emitting diode (LED) is widely used.

An LED print head has a complicated structure and is manufactured by arranging chips, and thus there is a limit in positional accuracy and the like. Therefore, an exposure device using an organic electroluminescence (EL) which can be manufactured by cutting out from a large-area panel of light emitting material is of interest.

As the light amount per unit area during the light emission increases, the lifespan of the organic EL light emitting element becomes shorter. Therefore, the organic EL light emitting element is formed to have a larger area than that of the LED light emitting element.

However, simply, as the area of the organic EL light emitting element increases, light spots formed on the photoconductor becomes larger, and thus the reproducibility of isolated points and fine lines decreases.

DETAILED DESCRIPTION

The image forming apparatus includes a photoconductor, a plurality of light emitting elements, a developing device, a fixing device, and a controller. The photoconductor is charged. The plurality of light emitting elements form light spots on the photoconductor by emitting light in order to form an electrostatic latent image on the photoconductor and are provided to have a first distance with each other in a main scanning direction. The developing device develops the electrostatic latent image on the photoconductor to a toner image. The fixing device fixes the toner image to a sheet. The controller causes the plurality of light emitting elements to form first light spots on the photoconductor, causes the photoconductor to move toward the plurality of light emitting elements by a second distance which is shorter than the first distance in a sub-scanning direction orthogonal to the main scanning direction, and causes the plurality of light emitting elements to form second light spots on the photoconductor.

Hereinafter, the embodiment is described with reference to the drawings.

First, with reference to FIGS. 1 to 5, configurations of a print head and an image forming apparatus including the print head according to at least one embodiment are described. Next, with reference to FIGS. 6A and 9, the light emission control of the light emitting element of the print head according to an aspect of at least one embodiment is described.

[Configuration]

Figure 1:
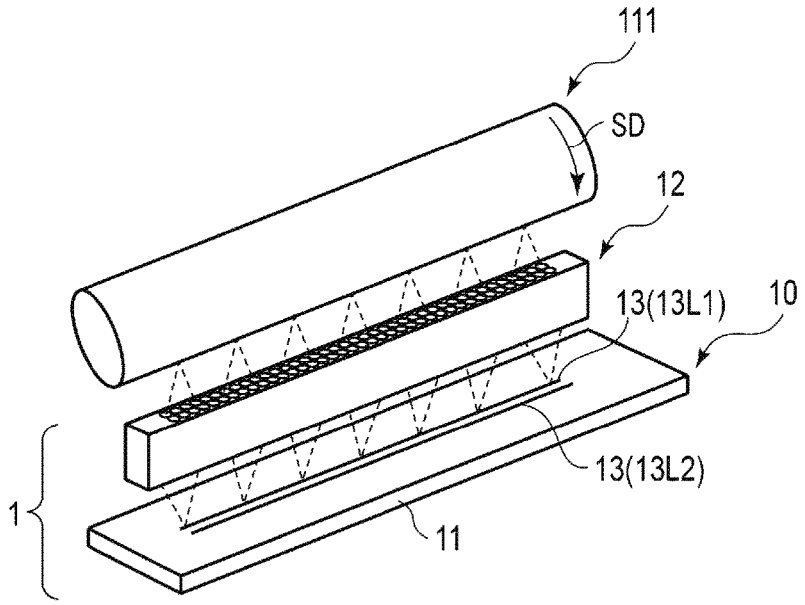
FIG. 1 is a diagram illustrating an example of a positional relationship between a photoconductor and a print head used in an image forming apparatus according to some embodiments.

FIG. 1 is a diagram illustrating an example of a positional relationship between a photoconductor (image carrier) 111 and a print head 1 used in an image forming apparatus 100 according to the embodiment. For example, the image forming apparatus 100 which is a printer, a copier, or a multifunctional peripheral includes the photoconductor 111 illustrated in FIG. 1, and the print head 1 is an organic EL print head using an organic EL light emitting material and is arranged to face the photoconductor 111.

The photoconductor 111 rotates in a direction of an arrow illustrated in FIG. 1. This rotation direction is called a sub-scanning direction SD. The photoconductor 111 is uniformly charged by a charger, exposed to light from the print head 1, and thus the potential of the exposed portion decreases. That is, by controlling light emission and non-light emission of the print head 1, an electrostatic latent image can be formed on the photoconductor 111.

The print head 1 includes a light emitting unit 10 and a lens array 12. The light emitting unit 10 includes a transparent substrate 11. For example, the transparent substrate 11 is a glass substrate that transmits light. One or a plurality of columns of light emitting element arrays 13 including a plurality of light emitting elements formed on the transparent substrate 11. In FIG. 1, an example in which two columns including a first light emitting element array (first array) 13L1 and a second light emitting element array (second array) 13L2 formed in parallel is described.

Figure 2:
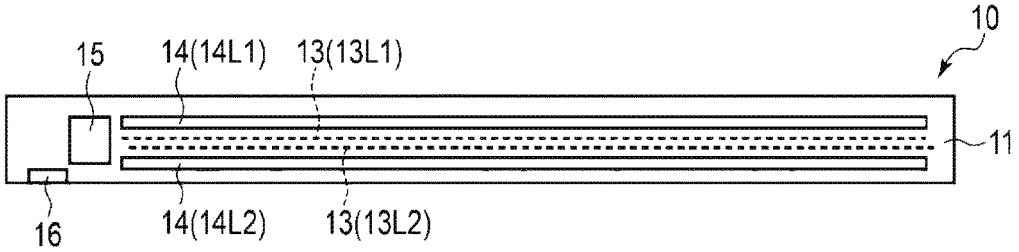
FIG. 2 is a diagram illustrating an example of a transparent substrate that configures the print head according to some embodiments.

FIG. 2 is a diagram illustrating an example of a transparent substrate that configures the print head 1 according to the embodiment. As illustrated in FIG. 2, two light emitting element arrays 13 (the first light emitting element array 13L1 and the second light emitting element array 13L2) are formed along the longitudinal direction of the transparent substrate 11 in a central portion on the transparent substrate 11. DRV circuit arrays 14 (first DRV circuit array 14L1 and second DRV circuit array 14L2) for driving (light emitting) each light emitting element are formed near the light emitting element arrays 13.

In FIG. 2, the DRV circuit arrays 14 for driving (light emitting) light emitting elements are arranged on both sides of the two light emitting element arrays 13, but the DRV circuit arrays 14 may be arranged on one side.

An integrated circuit (IC) 15 is arranged on an end portion of the transparent substrate 11. The IC 15 is specifically described below with reference to FIG. 2. The transparent substrate 11 includes a connector 16. The connector 16 electrically connects the print head 1 and a control system of a printer, a copier, or a multifunction peripheral. This connection enables power supply, head control, transfer of image data, and the like. The transparent substrate 11 is provided with a substrate for sealing the light emitting element array 13, the DRV circuit arrays 14 and the like to prevent contact with the outside air.

Figure 3:
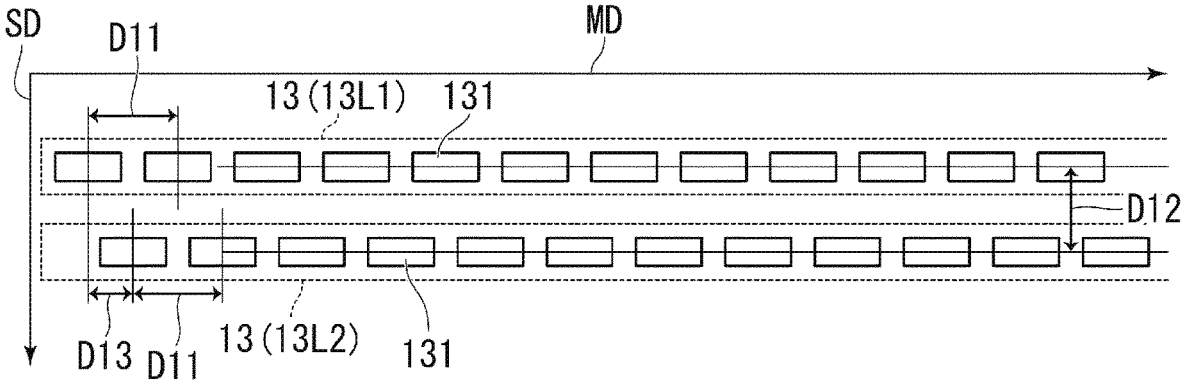
FIG. 3 is a diagram illustrating an example of a light emitting element array according to some embodiments.

FIG. 3 is a diagram illustrating an example of a light emitting element array (2 column head) according to the embodiment. As illustrated in FIG. 3, each of the light emitting element arrays 13 (the first light emitting element array 13L1 and the second light emitting element array 13L2) includes a plurality of light emitting elements 131 arranged along a main scanning direction MD which is perpendicular to a moving direction (the sub-scanning direction SD) of the photoconductor 111. That is, the plurality of light emitting elements 131 that form the light emitting element array 13 on the first column and the plurality of light emitting elements 131 that form the light emitting element array 13 on the second column are in parallel with respect to the main scanning direction MD. Three or more columns of light emitting element arrays may be provided.

The plurality of light emitting elements 131 is formed, for example, in a rectangular shape in which a width in the main scanning direction MD is longer than a width in the sub-scanning direction SD. An arrangement interval (first distance) D11 between light emission centers of the light emitting elements 131 is, for example, about 42.3 μm pitch (first pitch) at which the resolution is 600 dpi.

The light emitting element array 13 on the first column and the light emitting element array 13 on the second column are arranged at an interval of a distance D12 in the sub-scanning direction SD. A light emission center of each of the light emitting elements 131 that form the light emitting element array 13 on the first column and a light emission center of each of the light emitting elements 131 that form the light emitting element array 13 on the second column are arranged to be deviated by a predetermined pitch D13 in the main scanning direction MD. For example, the predetermined pitch D13 is ½ of the arrangement interval D11. Accordingly, the two light emitting element arrays 13 are arranged in a staggered manner in the main scanning direction MD and the sub-scanning direction SD.

When the light emitting elements 131 of the light emitting element arrays 13 on the first and second columns emit light at the same timing, the exposure pattern is formed on the photoconductor 111 in a staggered shape. The upstream side of the photoconductor 111 in the moving direction is set as the first column, and the downstream side is set as the second column, a controller (a controller 174 of FIG. 5) described below causes the light emitting element array 13 on the first column and the light emitting element array 13 on the second column to emit light at different timings according to the moving speed of the photoconductor 111 and the distance D12.

That is, the controller 174 delays the light emission timing of the light emitting element array 13 on the second column with respect to the light emitting element array 13 on the first column for a certain period of time according to the moving speed of the photoconductor 111 and the distance D12. In other words, the controller 174 outputs first light emitting element image data to the light emitting element array 13 on the first column and second light emitting element image data to the light emitting element array 13 on the second column at different timings according to the moving speed of the photoconductor 111 and the distance D12. Here, the first light emitting element image data and the second light emitting element image data correspond to image data for one line in the main scanning direction. Accordingly, a latent image is formed on the photoconductor 111 at the resolution of 1,200 dpi.

Hereinafter, a maximum resolution of pixels that can be formed by the print head is called a head resolution, and a resolution of pixels that is actually formed by the print head by controlling the print head is called a set resolution.

In this manner, the controller 174 can increase the density of an image by controlling the light emission timing (image data transfer timing) of the plurality of light emitting element arrays 13. In a case of the two light emitting element arrays 13, the density of the image can be increased to two times of the density of the light emitting elements 131 for one first column, in a case of n (n≥3, n: integer) light emitting element arrays 13, the density of the image can be increased by n times of the density of the light emitting elements 131 for one column.

The lens array 12 focuses the light emitted by the light emitting elements 131 and forms light beams. The light beams form light spots on the photoconductor 111. Hereinafter, the light spot refers to a portion of the photoconductor 111 where a portion having energy equal to or more than $1/e^2$ of the peak energy of the light beam is exposed.

The print head 1 is configured so that the width of a light spot formed by one of the light emitting elements 131 in the main scanning direction MD is to be greater than the arrangement interval D11. That is, the print head 1 is configured so that the width of the light spot of the photoconductor 111 in the main scanning direction MD is equal to or more than the pitch in a ½ resolution of the head resolution.

Figure 4:
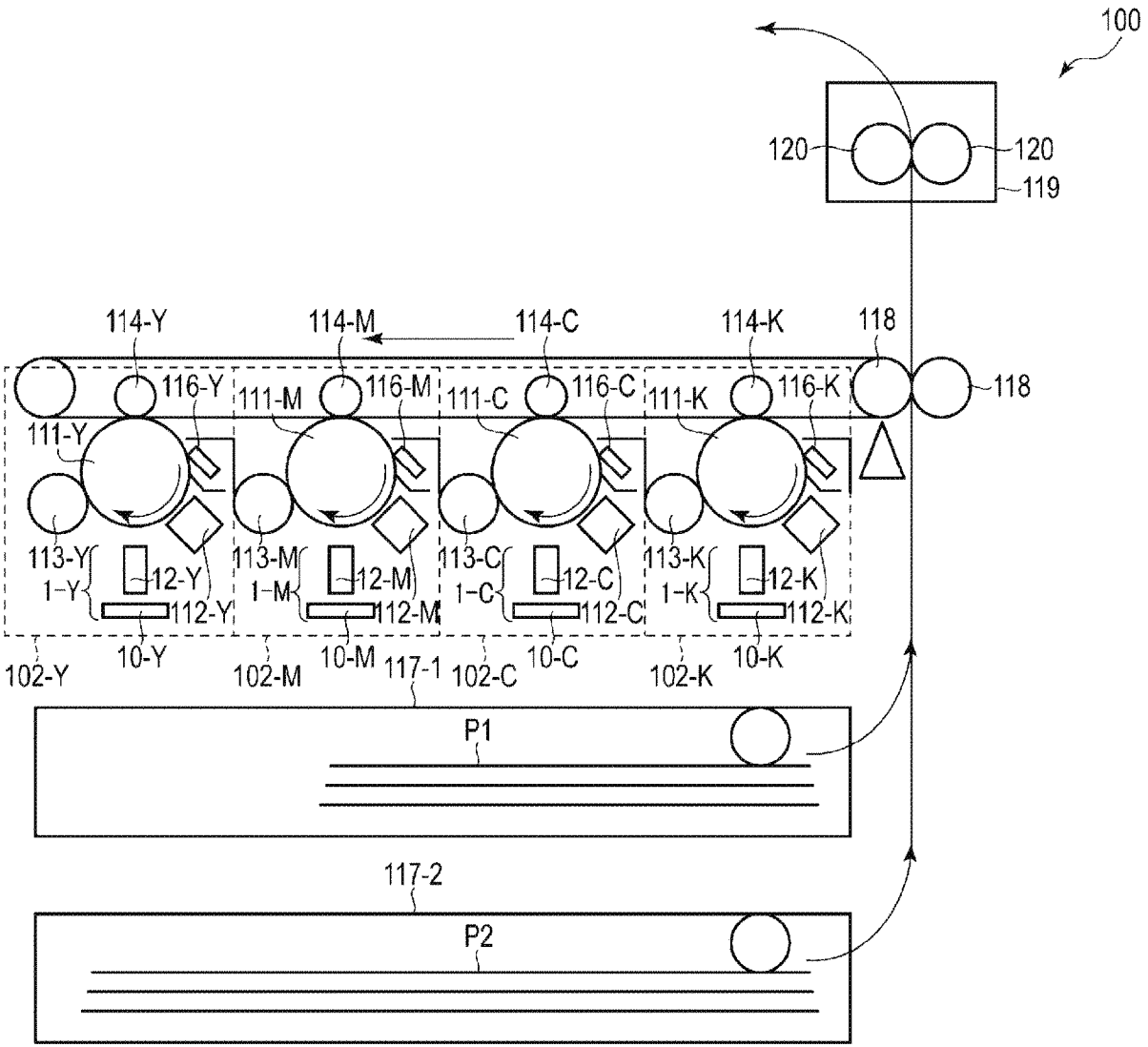
FIG. 4 is a diagram illustrating an example of the image forming apparatus according to some embodiments.

FIG. 4 is a diagram illustrating an example of the image forming apparatus to which the print head according to at least one embodiment is applied. FIG. 4 illustrates an example of a quadruple tandem type color image forming apparatus, but the print head 1 of at least one embodiment can be applied to a monochrome image forming apparatus.

As illustrated in FIG. 4, for example, the image forming apparatus 100 includes an image forming unit 102-Y that forms a yellow (Y) image, an image forming unit 102-M that forms a magenta (M) image, an image forming unit 102-C that forms a cyan (C) image, and an image forming unit 102-K that forms a black (K) image. The image forming units 102-Y, 102-M, 102-C, and 102-K form yellow, cyan, magenta, and black images respectively and transfer the images to a transfer belt 103. Accordingly, a full color image is formed on the transfer belt 103.

The image forming unit 102-Y includes a charger 112-Y, a print head 1-Y, a developing device 113-Y, a transfer roller 114-Y, and a cleaner 116-Y near a photoconductor 111-Y. The image forming units 102-M, 102-C, and 102-K are configured in the same manner.

In FIG. 4, a reference numeral "-Y" is provided to the configuration of the image forming unit 102-Y that forms a yellow (Y) image. A reference numeral "-M" is provided to the configuration of the image forming unit 102-M that forms a magenta (M) image. A reference numeral "-C" is provided to the configuration of the image forming unit 102-C that forms a cyan (C) image. A reference numeral "-K" is provided to the configuration of the image forming unit 102-K that forms a black (K) image.

The chargers 112-Y, 112-M, 112-C, and 112-K respectively charge the photoconductors 111-Y, 111-M, 111-C, and 111-K in the same manner. The print heads 1-Y, 1-M, 1-C, and 1-K respectively expose the photoconductors 111-Y, 111-M, 111-C, and 111-K by emitting light from the light emitting elements 131 of the first light emitting element array 13L1 and the second light emitting element array 13L2, thus forming an electrostatic latent image on the photoconductors 111-Y, 111-M, 111-C, and 111-K. The developing device 113-Y, the developing device 113-M, the developing device 113-C, and the developing device 113-K attach (develop) a yellow toner, a magenta toner, a cyan toner, and a black toner, to electrostatic latent image portions of the photoconductors 111-Y, 111-M, 111-C, and 111-K, respectively.

The transfer rollers 114-Y, 114-M, 114-C, and 114-K transfer the toner images developed on the photoconductors 111-Y, 111-M, 111-C, and 111-K to the transfer belt 103. The cleaners 116-Y, 116-M, 116-C, and 116-K clean toners that are not transferred and remain on the photoconductors 111-Y, 111-M, 111-C, and 111-K and enter a standby state for the next image formation.

A first size (small size) sheet (image forming medium) P1 is stored in a sheet cassette 117-1 which is a sheet supply unit. A second size (large size) sheet (image forming medium) P2 is stored in a sheet cassette 117-2 which is a sheet supply unit.

It is necessary to change the image forming position (image forming area in the main scanning direction MD) according to the paper size. The change of the image forming position is specifically described below with reference to FIG. 5.

A toner image is transferred by a transfer roller pair 118 which is a transfer unit from the transfer belt 103 to the sheet P1 or P2 extracted from the sheet cassette 117-1 or 117-2. The sheet P1 or P2 to which the toner image is transferred is heated or pressed by a fixing roller 120 of a fixing device 119. By the heating and pressurization by the fixing roller 120, the toner image is firmly fixed to the sheet P1 or P2. By repeating the above process operations, the image forming operation is continuously performed.

Figure 5:
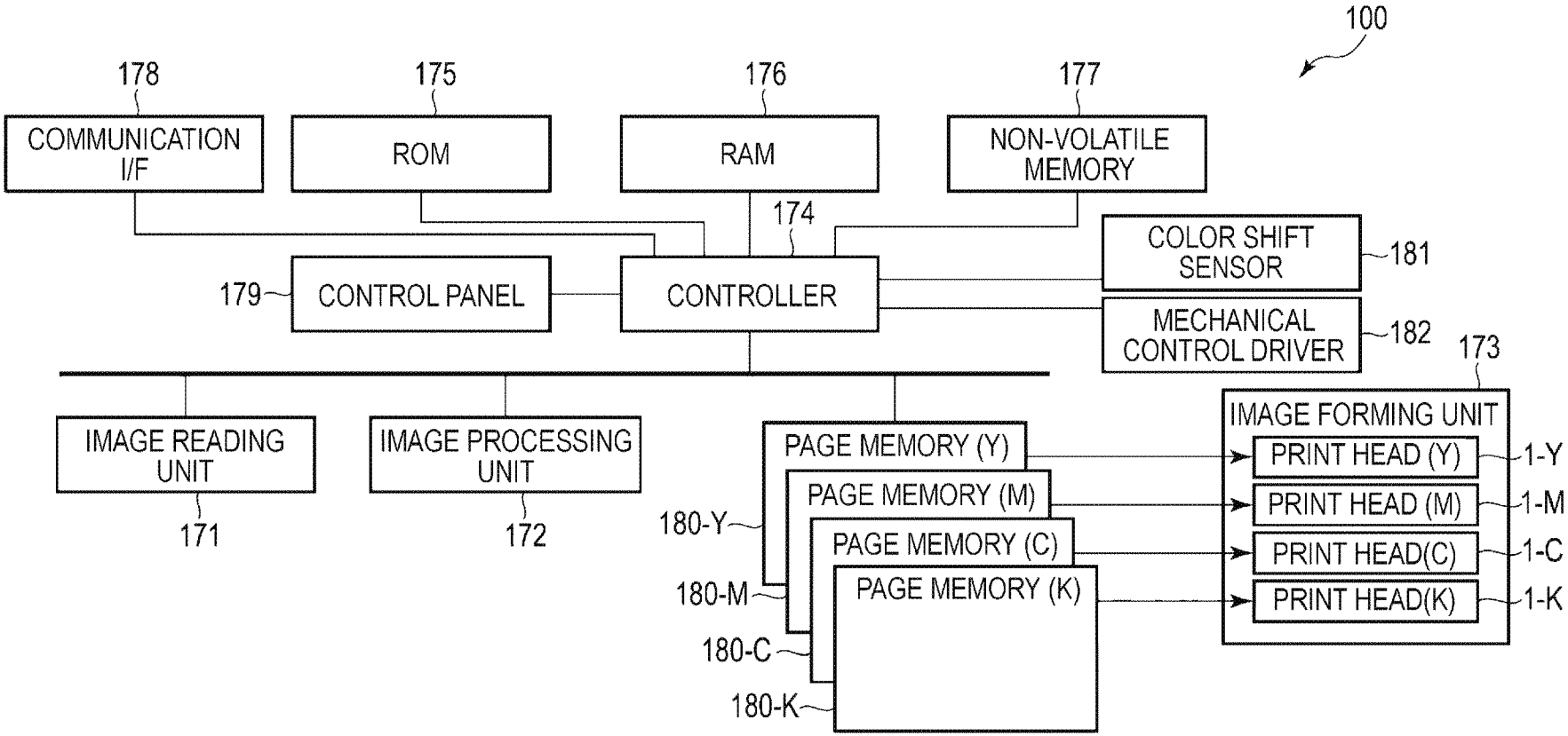
FIG. 5 is a block diagram illustrating an example of a control system according to some embodiments.

FIG. 5 is a block diagram illustrating an example of a control system of the image forming apparatus according to the embodiment. As illustrated in FIG. 5, the image forming apparatus 100 includes an image reading unit 171, an image processing unit 172, an image forming unit 173, the controller 174, a read only memory (ROM) 175, a random access memory (RAM) 176, a nonvolatile memory 177, a communication I/F 178, a control panel 179, a page memory 180-Y, a page memory 180-M, a page memory 180-C, a page memory 180-K, a color shift sensor 181, a mechanical control driver 182, and an image data bus 183. The image forming unit 173 includes the image forming unit 102-Y, the image forming unit 102-M, the image forming unit 102-C, and the image forming unit 102-K.

The ROM 175, the RAM 176, the nonvolatile memory 177, the communication I/F 178, the control panel 179, the color shift sensor 181, and the mechanical control driver 182 are connected to the controller 174.

The image reading unit 171, the image processing unit 172, the controller 174, the page memory 180-Y, the page memory 180-M, the page memory 180-C, and the page memory 180-K are connected to the image data bus 183. To the page memory 180-Y, the page memory 180-M, the page memory 180-C, and the page memory 180-K, the print head 1-Y, the print head 1-M, the print head 1-C, and the print head 1-K corresponding thereto are respectively connected.

The controller 174 is configured with one or more processors and controls issuing of one or more commands such as image reading, image processing, and image formation (including light emission control of alight emitting element) according to various programs stored at least one of the ROM 175 and the nonvolatile memory 177.

The ROM 175 stores various programs required for control by the controller 174.

The RAM: 176 temporarily stores data required for control by the controller 174. The nonvolatile memory 177 stores updated programs, various parameters, or the like. The nonvolatile memory 177 may store a portion or all of the various kinds of programs.

The mechanical control driver 182 controls operations of motors or the like required during printing or the like, according to the instruction of the controller 174. The communication I/F 178 outputs various kinds of information to the outside or inputs various kinds of information from the outside. For example, the image forming apparatus 100 prints image data input via a communication I/F by a print function. The control panel 179 receives an operation input from a user or a service person.

The image reading unit 171 optically reads an image of a document to obtain image data and outputs the image data to the image processing unit 172. The image processing unit 172 performs various kinds of image processing (including correction or the like) on the image data input via the communication I/F 178 or the image data from the image reading unit 171. The page memory 180-Y, the page memory 180-M, the page memory 180-C, and the page memory 180-K store image data processed by the image processing unit 172. The controller 174 controls the image data on the page memory 180-Y, the page memory 180-M, the page memory 180-C, and the page memory 180-K to be matched with the print position and the print head. The image forming unit 173 forms an image based on the image data stored in the page memory 180-Y, the page memory 180-M, the page memory 180-C, and the page memory 180-K. The image forming unit 173 includes the print head 1-Y, the print head 1-M, the print head 1-C, and the print head 1-K.

The controller 174 inputs test patterns to the page memory 180-Y, the page memory 180-M, the page memory 180-C, and the page memory 180-K and form the test patterns. The color shift sensor 181 detects the test patterns formed on the transfer belt 103 and outputs a detection signal to the controller 174. The controller 174 can recognize the positional relationship of the test patterns of the colors from the input of the color shift sensor 181.

The controller 174 selects the sheet cassette 117-1 or the sheet cassette 117-2 that feeds the paper for forming an image via the mechanical control driver 182.

[Light Emission Control]

Subsequently, with reference to FIGS. 6A to 8B, in the image forming apparatus 100, a light emission control method of the light emitting elements 131 of the print head 1 when printing is performed with pixels of 600 dpi resolution is described.

Figure 6A:
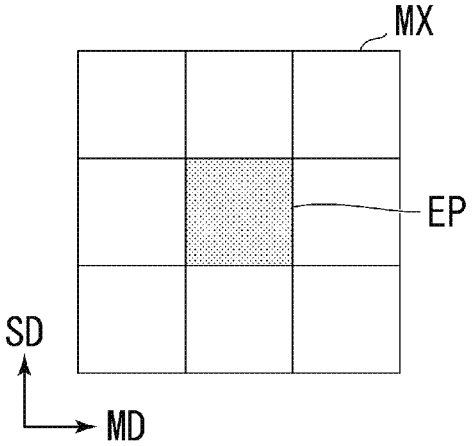
FIGS. 6A and 6B are diagrams illustrating correspondence between exposure positions and light spots of the photoconductor according to some embodiments.
Figure 6B:
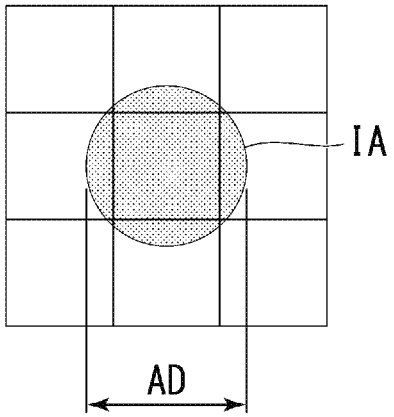

FIGS. 6A and 6B illustrate a reference example which is an example in which light spots are formed at exposure positions on the photoconductor 111 corresponding to the image data stored in the page memory by using 600 dpi print heads having light emitting elements arranged in one column in the main scanning direction. FIGS. 7A to 8B illustrate a case where the light spots are formed at exposure positions on the photoconductor 111 corresponding to the image data stored in the page memory by using the print head 1 according to some embodiments.

Figure 7A:
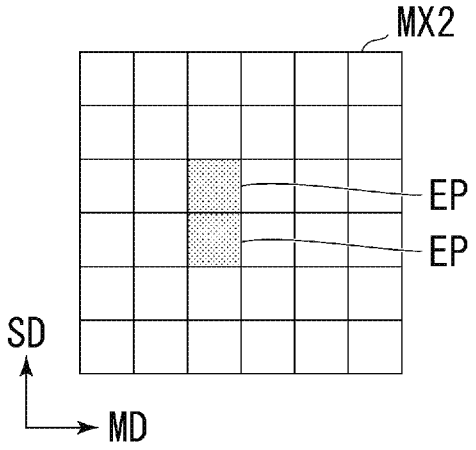
FIGS. 7A and 7B are diagrams illustrating correspondence between exposure positions and light spots of the photoconductor according to a first embodiment.
Figure 7B:
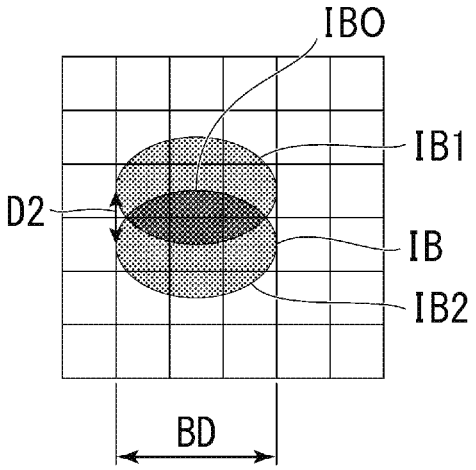
Figure 8A:
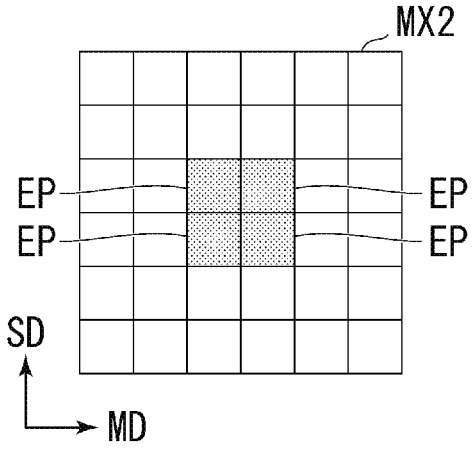
FIGS. 8A and 8B are diagrams illustrating correspondence between exposure positions and light spots of the photoconductor according to a second embodiment.
Figure 8B:
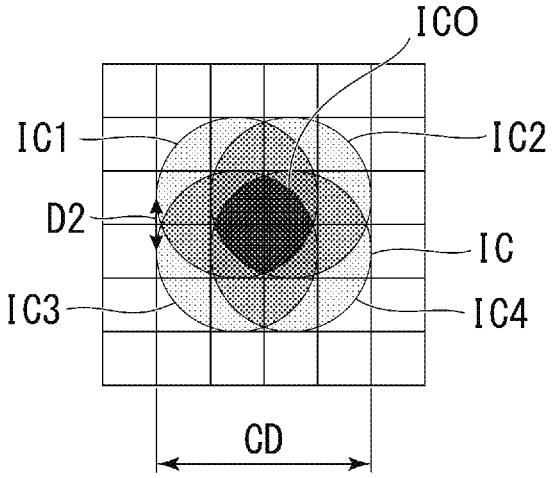

In the image forming apparatus 100, the light emission control method (first method) illustrated in FIGS. 7A and 7B and the light emission control method (second method) illustrated in FIGS. 8A and 8B can be used in switching.

In the light emission control according to at least one embodiment, first, as illustrated in FIGS. 6A to 8B, the controller 174 maps exposure positions on a matrix (pixel matrix) having a number of rows and columns corresponding to the head resolution based on the image data stored in the page memory.

Subsequently, the controller 174 causes each light emitting element arranged in the main scanning direction MD in the print head to correspond to each column arranged in the main scanning direction (row direction) MD in the matrix.

Subsequently, the controller 174 reads the exposure positions in each row arranged in the sub-scanning direction (column direction) SD in the matrix.

Subsequently, the photoconductor 111 is rotated in the sub-scanning direction SD, and the light emitting elements corresponding to the exposure positions are caused to emit light at timings corresponding to the exposure positions to form light spots on the photoconductor 111.

FIG. 6A illustrates a state in which only one mass of a matrix MX corresponding to 600 dpi is considered to be an exposure position EP as the isolated point. FIG. 6B illustrates a light spot IA on the photoconductor 111 corresponding to the exposure position EP of FIG. 6A. In FIGS. 6A and 6B, the print head causes one light emitting element to emit light once to form the light spot IA in the photoconductor 111.

FIG. 7A illustrates a state in which the exposure positions EP corresponding to two masses are formed to 600 dpi isolated points in the matrix MX2 corresponding to 1,200 dpi. FIG. 7B illustrates light spots IB on the photoconductor 111 corresponding to the exposure positions EP of FIG. 7A. In FIGS. 7A and 7B, the print head 1 causes one of the light emitting elements 131 to emit light twice to form the light spots IB on the photoconductor 111.

As illustrated in FIG. 7B, in the first method, when the 600 dpi isolated points are formed, after a first light spot IB1 is formed, the photoconductor 111 is moved by a certain distance (second distance) D2 in the sub-scanning direction SD with respect to the light emitting element 131 and form a second light spot IB2. The distance D2 is a ½ distance of the arrangement interval D11. The distance D2 is smaller than the arrangement interval D11. The light spot IB includes an overlapping portion IBO in which the first light spot IB1 and the second light spot IB2 are overlapped with each other.

FIG. 8A illustrates a state in which four masses corresponding to 600 dpi isolated points in the matrix MX2 corresponding to 1,200 dpi form the exposure positions EP. FIG. 8B illustrates light spots IC on the photoconductor 111 corresponding to the exposure positions EP of FIG. 8A. In FIG. 8, the print head 1 causes two of the adjacent light emitting elements 131 separated from each other by the predetermined pitch D13 in the main scanning direction MD to emit light twice, to form the light spots IC on the photoconductor 111.

As illustrated in FIG. 8B, in the second method, when 600 dpi isolated points are formed, while the photoconductor 111 is moved, one of the light emitting elements 131 forms a first light spot IC1 and a third light spot IC3. The light emitting element 131 separated from the light emitting element 131 that forms the first light spot IC1 and the third light spot IC3 by the predetermined pitch D13 in the main scanning direction MD forms a second light spot IC2 and a fourth light spot IC4. The first light spot IC1 and the third light spot IC3 are separated from each other by a distance D2 in the sub-scanning direction SD. The second light spot IC2 and the fourth light spot IC4 are separated from each other by the distance D2 in the sub-scanning direction SD. The first light spot IC1 and the second light spot IC2 are formed at the same position in the sub-scanning direction SD. The light spot IC includes an overlapping portion ICO in which the first light spot IC1, the second light spot IC2, the third light spot IC3, and the fourth light spot IC4 are overlapped with each other.

In the first method, the light amount of the exposure of the light emitting element 131 to one pixel is two times of the light amount of the exposure of one of the light emitting elements 131 to one pixel in the second method.

In the second method, the light amount of one time of the exposure of one of the light emitting elements 131 to one pixel is ¼ of the light amount of the exposure of the light emitting element to one pixel in the 600 dpi print head.

In the second method, a diameter CD of the light spot IC in the main scanning direction MD is longer than a diameter AD of the light spot IA of the isolated point of the 600 dpi print head in the main scanning direction MD.

In the first method, a diameter BD of the light spot IB in the main scanning direction MD is the same as the diameter AD of the light spot IA of the isolated point of the 600 dpi print head in the main scanning direction MD. In the first method, the total light amount of the exposure with respect to one pixel is the same as that in the second method, but the diameter BD of the light spot IB is smaller than the diameter CD of the light spot IC in the second method. Thus the reproducibility of isolated points and fine lines is better in the first method than that in the second method.

In the first method, the print head 1 may cause one of the light emitting elements 131 not to emit light twice, but to emit light continuously. In the first method, when one of the light emitting elements 131 of the print head 1 is caused to emit light continuously, the light amount of the exposure is caused to be four times of the light amount of one time of the exposure of one of the light emitting elements 131 in the second method.

In the first and second methods, the light amount of the exposure is adjusted by adjusting the light emission duty ratio. The light emission duty ratio may be adjusted in the range of 5% to 90%. In the first and second methods, the light amount of the exposure may be adjusted by adjusting the light amount of the light beams per unit area of the light emitting element 131.

In the first and second methods, the light amount of the light beam required for forming the pixel of the 600 dpi resolution to one pixel of 600 dpi is preferably 50 nW or less.

Figure 9:
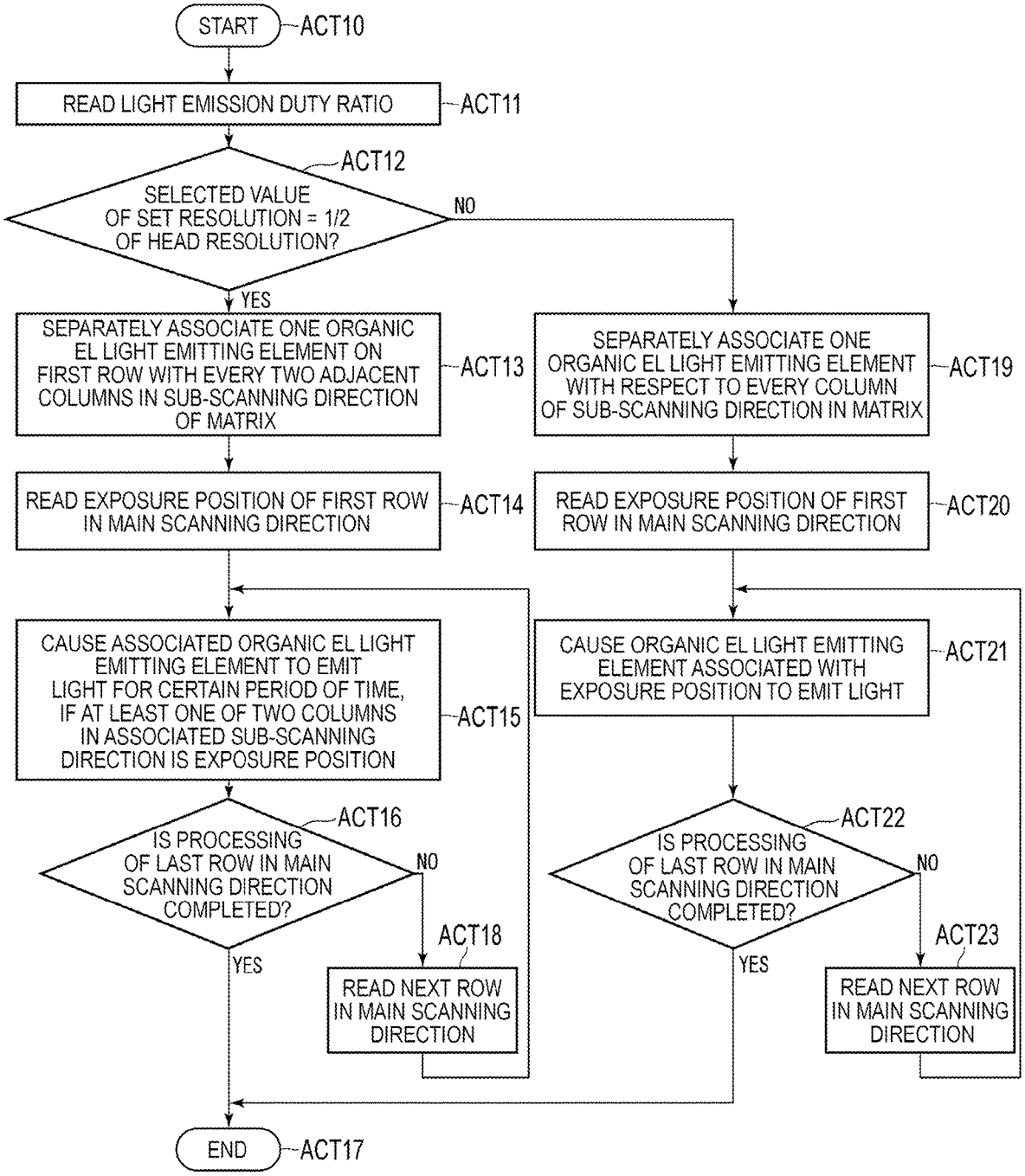
FIG. 9 is a flowchart for describing an example of light emission control and image formation according to some embodiments.

FIG. 9 is a flowchart for describing the light emission control method of the light emitting elements 131 of the print head 1. The flowchart illustrated in FIG. 9 describes processes after the exposure positions EP in the matrix MX2 are determined.

In ACT 11, the controller 174 reads a set value of the light emission duty ratio. The set value of the light emission duty ratio may be stored in the ROM 175 or the like in advance or may be input by the user via the control panel 179 or the like. The controller 174 proceeds to ACT 12 after performing the process of ACT 11.

In ACT 12, the controller 174 reads a selected value of the set resolution and determines whether the selected value is ½ of the head resolution. When the selected value of the set resolution is ½ of the head resolution, the controller 174 proceeds to ACT 13 below and performs the light emission control of the first method. The selected value of the set resolution is input by the user via the control panel 179 or the like. When the selected value of the set resolution is the same value as the head resolution, the controller 174 proceeds to ACT 19 and performs light emission control according to the second method.

In ACT 13, the controller 174 causes the light emitting elements 131 of the first light emitting element array 13L1 to correspond to each two columns of the sub-scanning direction SD adjacent to each other in the main scanning direction MD in the matrix MX2, respectively. The controller 174 proceeds to ACT 14 after performing the process of ACT 13.

In ACT 14, the controller 174 reads the exposure positions EP on the first row of the main scanning direction MD arranged in the sub-scanning direction SD of the matrix MX2. The controller 174 proceeds to ACT 15 after performing the process of ACT 13.

In ACT 15, the controller 174 causes the light emitting elements 131 to emit light to the photoconductor 111 that rotates in the sub-scanning direction SD to form the light spot IC. The controller 174 causes the light emitting elements 131 to emit light when at least one of the two columns of the matrix MX2 in the sub-scanning direction SD which corresponds to the light emitting elements 131 is the exposure positions EP. The controller 174 proceeds to ACT 16 after performing the process of ACT 15.

In ACT 16, the controller 174 determines whether the exposure positions EP of the last row of the main scanning direction MD arranged in the sub-scanning direction SD of the matrix MX2 are read. When the exposure positions EP of the last row of the main scanning direction MD are read, the controller 174 proceeds to ACT 17 below and ends the process. When the exposure positions EP of the last row of the main scanning direction MD are not read, the controller 174 proceeds to ACT 18 below.

In ACT 18, the controller 174 reads the exposure positions EP of the next row of the main scanning direction MD arranged in the sub-scanning direction SD of the matrix MX2. When performing the process of ACT 18, the controller 174 returns to ACT 15.

In ACT 19, the controller 174 causes the light emitting elements 131 of the first light emitting element array 13L1 and the second light emitting element array 13L2 to independently correspond to the sub-scanning direction SD arranged in the main scanning direction MD of the matrix MX2, respectively. The controller 174 proceeds to ACT 20 after performing the process of ACT 19.

In ACT 20, the controller 174 reads the exposure positions EP on the first row of the main scanning direction MD arranged in the sub-scanning direction SD of the matrix MX2. The controller 174 proceeds to ACT 21 after performing the process of ACT 20.

In ACT 21, the controller 174 causes the light emitting elements 131 to emit light to the photoconductor 111 that rotates in the sub-scanning direction SD to form the light spots IB. When columns of the sub-scanning direction SD of the matrix MX2 corresponding to the light emitting elements 131 are the exposure positions EP, the controller 174 causes the light emitting elements 131 to emit light. The controller 174 causes the light emission timing of the second light emitting element array 13L2 to the first light emitting element array 13L1 to delay for a predetermined period of time and causes the light emitting elements 131 to emit light. The controller 174 proceeds to ACT 22 after performing the process of ACT 21.

In ACT 22, the controller 174 determines whether the controller 174 reads the exposure positions EP on the last row of the main scanning direction MD arranged in the sub-scanning direction SD of the matrix MX2. When reading the exposure positions EP on the last row of the main scanning direction MD, the controller 174 proceeds to ACT 17 below and ends the process. When not reading the exposure positions EP on the last row of the main scanning direction MD, the controller 174 proceeds to ACT 23 below.

In ACT 23, the controller 174 reads the exposure positions EP on the next row of the main scanning direction MD arranged in the sub-scanning direction SD of the matrix MX2. The controller 174 returns to ACT 21 after performing the process of ACT 23.

As described above, in the image forming apparatus including: an image carrier to which toner to be transferred to paper is attached; and a print head including a plurality of light emitting elements that are arranged in a main scanning direction and a sub-scanning direction in a staggered shape and of which a width in the main scanning direction is larger than that in the sub-scanning direction, and lens arrays that focus light emitted from the light emitting elements to form light beams, exposing the light beam emitted from the lens arrays to portions to which the toner of the image carrier is attached, and causing a width in the main scanning direction in light spots of the image carrier of which portions having energy of $1/e^2$ or more of the peak energy of the light beam of one of the light emitting elements is exposed, to be a pitch or more of ½ resolution of a head resolution, the image forming method according to at least one embodiment includes a first method of causing a resolution of pixels formed of the plurality of light spots to be the ½ resolution of the head resolution and causing the light emitting elements arranged at a pitch of the ½ resolution of the head resolution in the main scanning direction to correspond to each two columns in a column direction which are adjacent to each other in a row direction of a pixel matrix corresponding to the head resolution, respectively.

In the image forming method according to at least one embodiment, a light amount of the exposure may be adjusted by changing a light emission duty ratio.

The image forming method according to at least one embodiment may have a second method that can be substituted with the first method and causing the resolution of the pixels to the ½ resolution of the head resolution and causing the light emitting elements to correspond to each one column of the sub-scanning direction arranged in the main scanning direction of the pixel matrix.

In the image forming method according to at least one embodiment, the head resolution may be 1,200 dpi, and the resolution of the pixels may be 600 dpi.

In the image forming method according to at least one embodiment, the head resolution may be 2,400 dpi, and the resolution of the pixels may be 1,200 dpi.

In the image forming method according to at least one embodiment, a light amount of one time of the exposure of one of the light emitting elements may be 50 nW or less.

In the image forming method according to at least one embodiment, the arrangement of the light emitting elements along the main scanning direction adjacent to each other in the sub-scanning direction may be deviated by a pitch of the head resolution in the main scanning direction.

In the image forming method of at least one embodiment, the width of the light emitting element in the main scanning direction may be 22 μm or more, and the width of the sub-scanning direction may be less than 22 μm.

In the image forming method according to at least one embodiment, the range of the light emission duty ratio may be 5% to 90%.

In the image forming method according to at least one embodiment, the width of the image in the main scanning direction may be 42 μm to 68 μm.

According to the image forming apparatus 100, in a case of the set resolution of ½ of the head resolution, one pixel can be formed by one of the light emitting elements 131. Therefore, according to the image forming apparatus 100, in a case of the set resolution of ½ of the head resolution, the width of the light spot in the main scanning direction MD can be caused to be the same in a case of using the print head which has the head resolution of ½ of the head resolution of the image forming apparatus 100. Accordingly, in a case of the set resolution of ½ of the head resolution of the image forming apparatus 100, the image forming apparatus 100 can prevent the decrease of the reproducibility of isolated points and fine lines compared with a case where the head resolution of ½ of the head resolution of the image forming apparatus 100 is used.

In the image forming apparatus, the head resolution of the print head may be 2,400 dpi, and the set resolution may be 1,200 dpi.

EXAMPLES

Hereinafter, the embodiment is described more specifically with reference to examples, but is not limited to the following examples.

The image forming apparatuses 100 having different widths of the light emitting elements 131 in the main scanning direction MD are prepared. In Table 1, in the first method and the second method, evaluation results of widths of light spots in the main scanning direction MD, measure of unevenness during solid image formation, and the reproducibility of vertical fine lines having a width of 600 dpi for each width of the light emitting elements 131 in the main scanning direction MD are provided. The reproducibility of vertical fine lines of 600 dpi is evaluated by comparison with vertical fine lines formed with a general print head having the head resolution of 600 dpi.

TABLE 1

| | | | | |
|---|---|---|---|---|
| | WIDTH OF LIGHT EMITTING ELEMENTS IN MAIN SCANNING DIRECTION (μm) | 22 | 27 | 37 |
| FIRST METHOD | WIDTH OF IMAGE MEASURED BY CCD IN MAIN SCANNING DIRECTION (μm) | 42 | 47 | 57 |
| | SOLID UNEVENNESS (good, OK, bad) | good | good | good |
| | 600 DPI-WIDTH VERTICAL FINE LINE REPRODUCIBILITY (good, OK, bad) | good | good | good |
| SECOND METHOD | WIDTH OF IMAGE MEASURED BY CCD IN MAIN SCANNING DIRECTION (μm) | 63 | 68 | 78 |
| | SOLID UNEVENNESS (good, OK, bad) | good | good | good |
| | 600 DPI-WIDTH VERTICAL FINE LINE REPRODUCIBILITY (good, OK, bad) | good | OK | bad |

From Table 1, it is understood that, when the width of the light spots in the main scanning direction MD is generally 42.3 μm (corresponding to a pitch of 600 dpi) or more, a satisfactory solid image can be obtained. It is understood that, when the width of the light spot in the main scanning direction MD is generally 63 μm (corresponding to a pitch of 400 dpi) or less, the reproducibility of fine lines is satisfactory.

From Table 1, it is understood that, in the second method, even of the width of the light emitting elements 131 in the main scanning direction MD is increased to 37 μm, the width of the light spots in the main scanning direction MD is 57 μm, and while the width of the light spots in the main scanning direction MD is maintained to be small, the increased lifespan of the element can be obtained.

According to at least one embodiment described above, in a case of the set resolution of ½ of the head resolution of the image forming apparatus 100, the decrease of the reproducibility of isolated points and fine lines can be prevented compared with a case of using the print head of the head resolution of ½ of the head resolution of the image forming apparatus 100.

While certain embodiments have been described these embodiments have been presented by way of example only, and are not intended to limit the scope of the inventions. Indeed, the novel embodiments described herein may be embodied in a variety of other forms. Furthermore, various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An image forming apparatus, comprising:

a photoconductor configured to be charged;

a plurality of light emitting elements configured to form light spots on the photoconductor by emitting light onto the photoconductor in order to form an electrostatic latent image on the photoconductor, the plurality of light emitting elements being arranged in a first column and a second column, the first column being spaced from the second column in a sub-scanning direction, the first column including a first light emitting element, and the second column including a second light emitting element, the light emitting elements of the first column being spaced at a first distance from each other in a main scanning direction that is orthogonal to the sub-scanning direction;

a developer configured to develop the electrostatic latent image on the photoconductor to form a toner image by applying toner;

a fixer configured to fix the toner image to a sheet; and a controller configured to:

cause the first light emitting element to form a first light spot on the photoconductor;

cause the second light emitting element to form a second light spot on the photoconductor;

cause the photoconductor to move relative to the plurality of light emitting elements by a second distance shorter than the first distance in the sub-scanning direction; and cause the first light emitting element to form a third light spot on the photoconductor, the first light spot, the second light spot, and the third light spot all overlapping with one another to form a pixel.

2. The image forming apparatus according to claim 1, wherein widths of the plurality of light emitting elements in the main scanning direction are longer than widths in the sub-scanning direction.

3. The image forming apparatus according to claim 1, wherein the second distance is half of the first distance.

4. The image forming apparatus according to claim 1, wherein the light emitting elements of the second column are arranged at a pitch in the main scanning direction, the pitch having a same length as the first distance.

5. The image forming apparatus according to claim 4, wherein the light emitting elements of the first column include light emission centers disposed at positions not overlapped with light emission centers of the light emitting elements of the second column.

6. The image forming apparatus according to claim 1, wherein the controller is further configured to cause the second light emitting element to emit a fourth light spot on the photoconductor, wherein the first light spot, the second light spot, the third light spot, and the fourth light spot overlap with one another to form the pixel.

7. The image forming apparatus according to claim 1, wherein the pixel is a first pixel, and in response to a change to a selected value of a set resolution, the controller is configured to:

cause the first light emitting element to form a fourth light spot on the photoconductor;

cause the photoconductor to move relative to the plurality of light emitting elements in the sub-scanning direction; and cause the first light emitting element to form a fifth light spot on the photoconductor, the fourth light spot and the fifth light spot overlapping with one another to form a second pixel.

8. A method of controlling an image forming apparatus including a controller, a charged photoconductor, and a print head comprising a plurality of light emitting elements spaced at a first distance, the method comprising:

mapping, by the controller, exposure positions in a matrix having rows and columns in a number corresponding to a resolution of the print head;

causing, by the controller, a first light emitting element of the plurality of light emitting elements in a main scanning direction of the print head to correspond to a first column of the matrix arranged in a sub-scanning direction;

causing, by the controller, a second light emitting element of the plurality of light emitting elements in the main scanning direction of the print head to correspond to a second column of the matrix arranged in the sub-scanning direction;

forming, by the first light emitting element, a first light spot on the charged photoconductor at a first one of the exposure positions;

causing, by the controller, the charged photoconductor to be moved in a sub-scanning direction a second distance;

forming, by the second light emitting element, a second light spot on the charged photoconductor at a second one of the exposure positions; and forming, by the first light emitting element, a third light spot on the charged photoconductor at a third one of the exposure positions, the first light spot, the second light spot, and the third light spot all overlapping with one another to form a pixel.

9. The method according to claim 8, wherein the second distance is half the first distance.

10. The method according to claim 8, wherein the plurality of light emitting elements are configured to emit an exposure amount of light, and the controller is configured to adjust the exposure amount by changing a light emission duty ratio.

11. The method according to claim 8, wherein the plurality of light emitting elements are arranged along the main scanning direction adjacent to each other in the sub-scanning direction; and the plurality of light emitting elements are deviated by a pitch in the main scanning direction.

12. The method according to claim 11, wherein the pitch is equal to the head resolution.

13. The method according to claim 11, wherein the pitch is equal to the set resolution.

14. The method according to claim 8, wherein the first light emitting element is arranged in a first array of the light emitting elements, and the second light emitting element is arranged in a second array of the light emitting elements, the first array being offset from the second array in the sub-scanning direction.

15. The method according to claim 8, further comprising forming, by the second light emitting element, a fourth light spot on the charged photoconductor at a fourth one of the exposure positions, wherein the first light spot, the second light spot, the third light, and the fourth light spot overlap with one another to form a pixel.

16. A method of controlling an image forming apparatus including a controller, a charged photoconductor, and a print head comprising a plurality of light emitting elements, the method comprising:

receiving, by the controller, a selected value of a set resolution;

in response to the selected value being a first value, causing, by the controller, a first light emitting element and a second light emitting element of the plurality of light emitting elements to form light spots on the charged photoconductor that overlap with one another to form a first pixel; and in response to the selected value being a second value, causing, by the controller, the first light emitting element to form a light spot on the charged photoconductor that forms a second pixel without using the second light emitting element to form the second pixel.

17. The method according to claim 16, wherein the second value is equal to half of a resolution of the print head, and the first value is not equal to half of the resolution of the print head.

* * * * *